US010065298B1

(12) United States Patent
Winscott

(10) Patent No.: US 10,065,298 B1
(45) Date of Patent: Sep. 4, 2018

(54) OIL FILTER REMOVAL TOOL

(71) Applicant: Richard Winscott, Whiteland, IN (US)

(72) Inventor: Richard Winscott, Whiteland, IN (US)

( * ) Notice: Subject to any disclaimer, the term of this patent is extended or adjusted under 35 U.S.C. 154(b) by 44 days.

(21) Appl. No.: 15/345,719

(22) Filed: Nov. 8, 2016

(51) Int. Cl.
*B25B 27/00* (2006.01)
*B25B 13/50* (2006.01)
*B25B 13/48* (2006.01)

(52) U.S. Cl.
CPC ..... *B25B 27/0042* (2013.01); *B25B 13/481* (2013.01); *B25B 13/5008* (2013.01)

(58) Field of Classification Search
CPC ..... B25B 27/0042; B25B 13/5008
USPC ..... 81/64
See application file for complete search history.

(56) References Cited

U.S. PATENT DOCUMENTS 3,385,141 A 5/1968 Norman
4,376,703 A * 3/1983 Krauss ..... B01D 35/31 184/1.5
4,865,727 A 9/1989 Krauss
4,867,017 A 9/1989 Holman
5,366,084 A 11/1994 Post
5,421,223 A * 6/1995 Wawrzyniak ..... B25B 27/0042 210/238
D474,382 S 5/2003 Tsai
7,107,878 B1 9/2006 Norman
7,241,385 B1 7/2007 Cline
7,340,979 B2 3/2008 Sawyer

FOREIGN PATENT DOCUMENTS

EP 1990136 A1 11/2008

* cited by examiner

*Primary Examiner* — Hadi Shakeri

(57) ABSTRACT

The oil filter removal tool is a hand tool. The oil filter removal tool installs and removes an oil filter from a vehicle engine. The oil filter is further defined with an outer diameter and a plurality of indentations. The oil filter removal tool is a cylindrical structure. The cylindrical structure of the oil filter removal tool contains oil leaks resulting from the removal of an oil filter from the vehicle engine. The cylindrical structure channels the oil leaks into the catch pan normally placed under the vehicle engine during an oil change. The oil filter removal tool comprises a pipe and a plurality of ridges. The plurality of ridges is mounted on the interior of the pipe.

8 Claims, 5 Drawing Sheets

OIL FILTER REMOVAL TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shaping including hand tools, more specifically, a hand tool configured for fitting together or separating parts.

SUMMARY OF INVENTION

The oil filter removal tool is a hand tool. The oil filter removal tool installs and removes an oil filter from a vehicle engine. The oil filter is further defined with an outer diameter and a plurality of indentations. The oil filter removal tool is a cylindrical structure. The cylindrical structure of the oil filter removal tool contains oil leaks resulting from the removal of an oil filter from the vehicle engine. The cylindrical structure channels the oil leaks into the catch pan normally placed under the vehicle engine during an oil change. The oil filter removal tool comprises a pipe and a plurality of ridges. The plurality of ridges is mounted on the interior of the pipe.

These together with additional objects, features and advantages of the oil filter removal tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the oil filter removal tool in detail, it is to be understood that the oil filter removal tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the oil filter removal tool.

It is therefore important that the claims be regarded as including such equivalent construction insofar as they do not depart from the spirit and scope of the oil filter removal tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
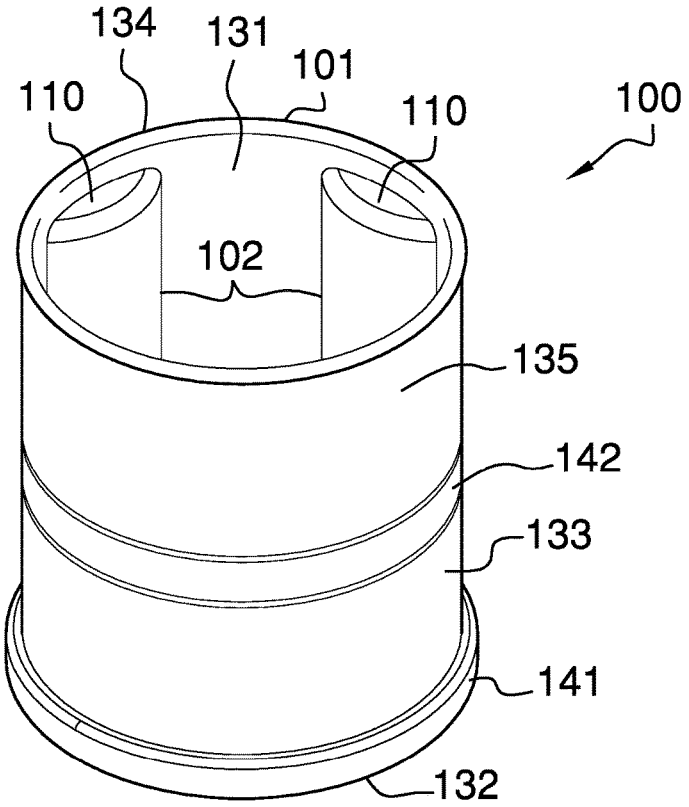
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The oil filter removal tool 100 (hereinafter invention) comprises a pipe 101 and a plurality of ridges 102. The plurality of ridges 102 is mounted on the interior surface 134 of the pipe 101. The invention 100 is a hand tool. The invention 100 installs and removes an oil filter 161 from a vehicle engine 162. The oil filter 161 is further defined with an outer diameter 164 and a plurality of indentations 165. The invention 100 is a cylindrical structure. The cylindrical structure of the invention 100 contains oil leaks 166 resulting from the removal of an oil filter 161 from the vehicle engine 162. The cylindrical structure channels the oil leaks 166 into a catch pan 163 placed under the vehicle engine 162.

The pipe 101 is a cylindrically shaped hollow rigid structure. The pipe 101 is further defined with a first base 131, a second base 132, a face 133, an interior surface 134 an exterior surface 135. The first base 131 is open such that access can be gained to the hollow interior of the pipe 101. The second base 132 is open such that access can be gained to the hollow interior of the pipe 101. The face 133 forms the cylindrical boundary of the pipe 101. The interior surface 134 is the concave side of the face 133. The exterior surface 135 is the convex side of the face 133.

The pipe 101 further comprises an inner diameter 136. The span of the inner diameter 136 is greater than the span of the outer diameter 164 of the oil filter 161 such that the oil filter 161 can be inserted into the hollow interior of the pipe 101.

The plurality of ridges 102 comprises a collection of individual ridges 110. Any individual ridge 110 selected from the plurality of ridges 102 is identical to the individual ridges 110 remaining within the plurality of ridges 102. Each individual ridge 110 is a semi-rigid structure that is formed from an elastomeric material. Each individual ridge 110 is mounted on the interior surface 134 of the pipe 101. Each individual ridge 110 selected from the plurality of ridges 102 are positioned such that each individual ridge 110 is equidistant for each of the individual ridges 110 to which the selected individual ridge 110 is adjacent. As shown most clearly in FIG. 2, each individual ridge 110 is shaped such that each individual ridge 110 presents a convex quadric surface 137 (hereinafter convex surface) towards the center axis of the pipe 101. Each individual ridge 110 is sized and shaped such that the individual ridge 110 will fit into an indentation selected from the plurality of indentations 165.

Figure 2:
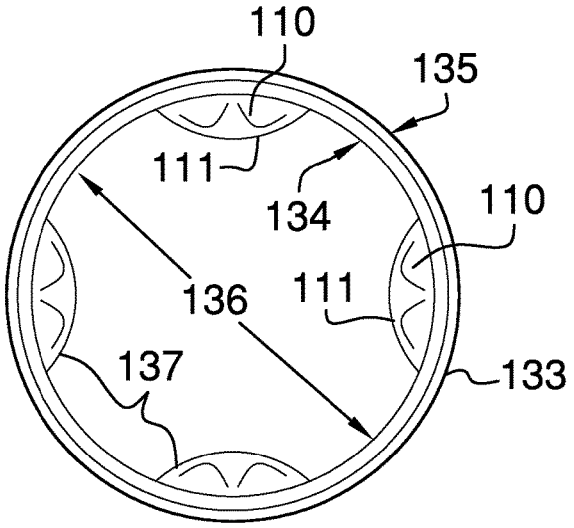
FIG. 2 is a bottom view of an embodiment of the disclosure.
Figure 3:
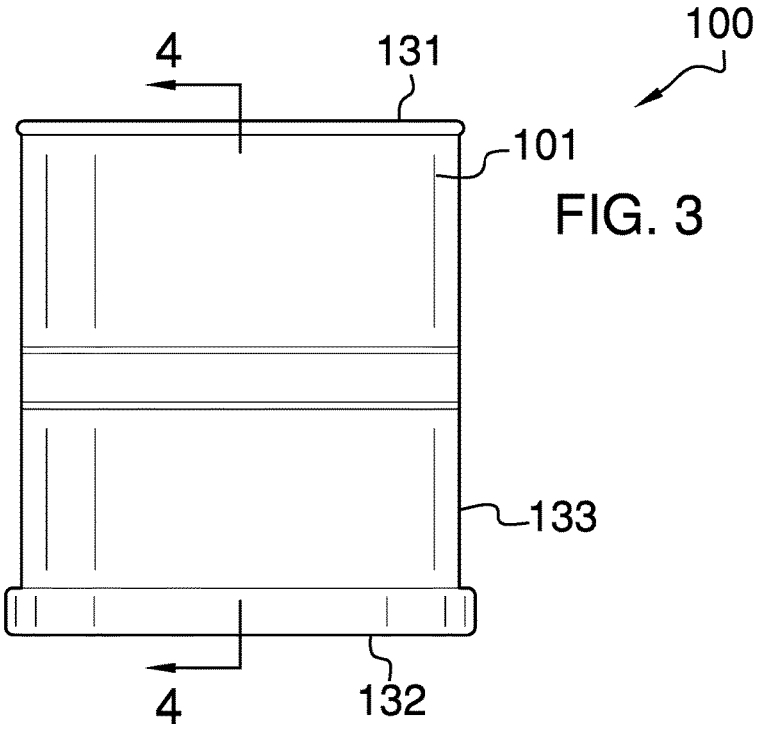
FIG. 3 is a side view of an embodiment of the disclosure.
Figure 4:
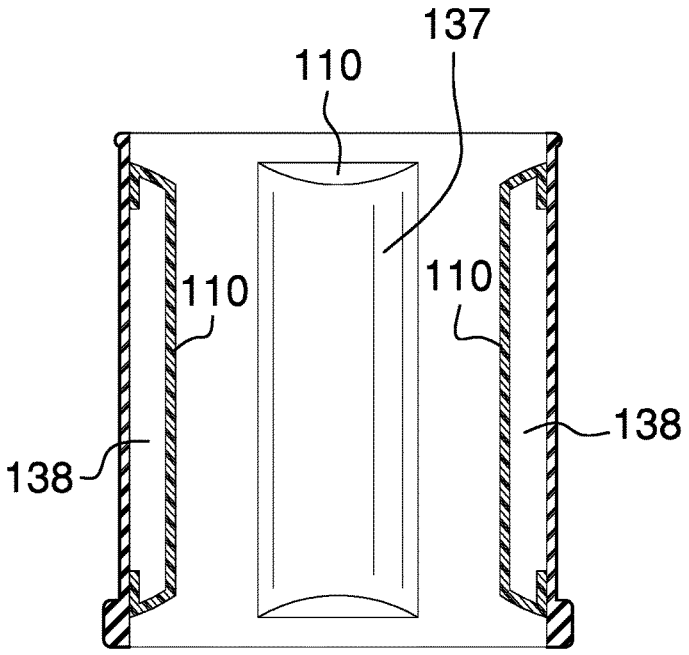
FIG. 4 is a cross-sectional view of an embodiment of the disclosure across 4-4 as shown in FIG. 3.

In the first potential embodiment of the disclosure, as shown most clearly in FIGS. 2 and 4, the convex surface 137 of each individual ridge 110 is an ellipsoidal segment. The semi-rigid structure that forms the individual ridge 110 deforms under a force in an elastic manner. As shown in the first potential embodiment of the disclosure, the individual ridge 110 forms a hollow space 138 between the convex surface 137 and the interior surface 134. In alternate embodiments of the disclosure, the materials chosen to form the individual ridge 110 may be such that the space between the convex surface 137 and the interior surface 134 will not be hollow.

Each individual ridge 110 acts as a spring. Specifically, when a force is applied perpendicularly to the convex surface 137 of the individual ridge 110, the elasticity of the individual ridge 110 creates a force that opposes the displacement created by the oil filter 161 pressing against the individual ridge 110. The displacing force places a strain on the individual ridge 110 creating an opposing force within the individual ridge 110 such that the opposing force of the strain is in the direction that returns the individual ridge 110 to its relaxed shape. When an oil filter 161 is inserted into the pipe 101, this spring like action from each of the plurality of ridges 102 produces a clamping force that holds the invention 100 securely in position against the oil filter 161.

Figure 5:
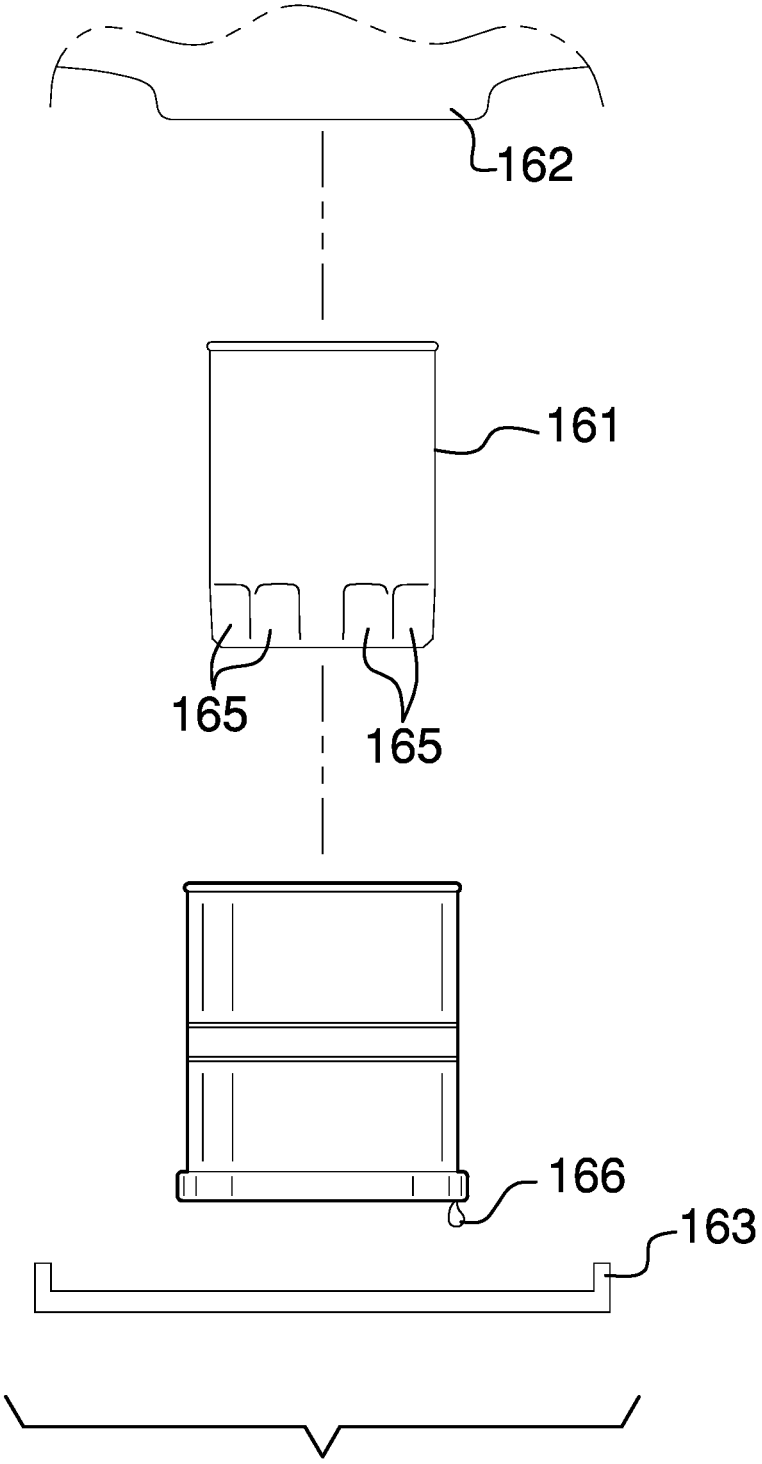
FIG. 5 is an exploded view of an embodiment of the disclosure.
Figure 6:
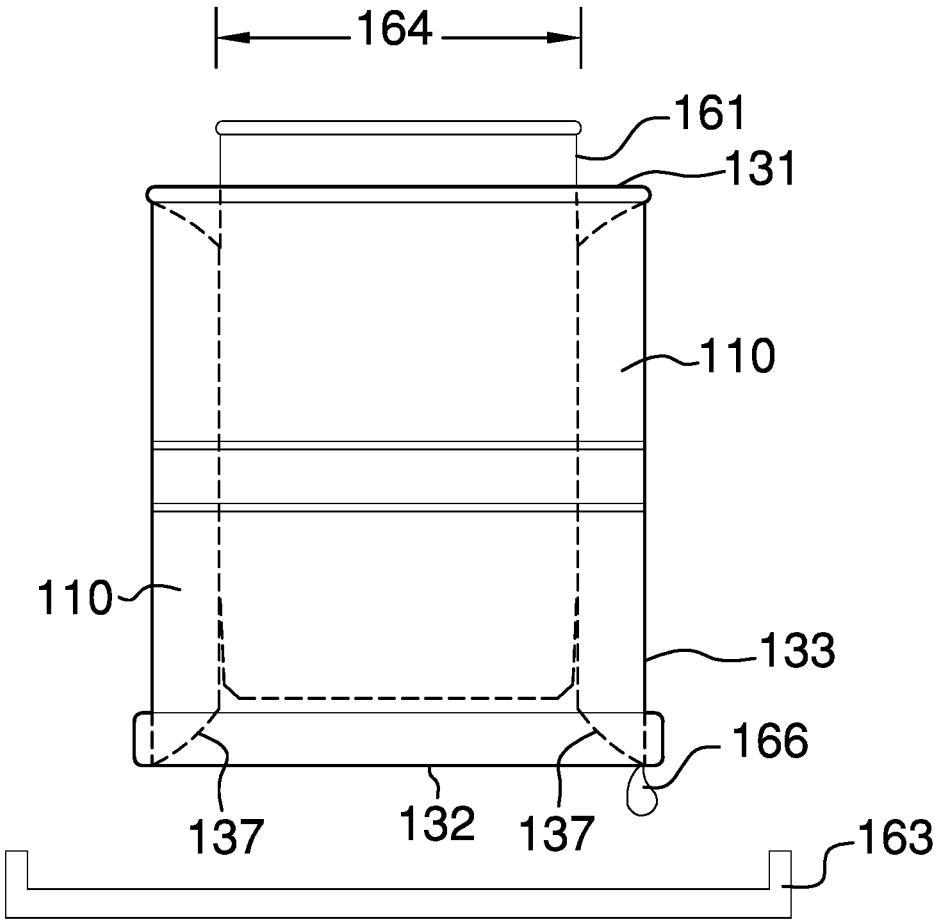
FIG. 6 is a detail view of an embodiment of the disclosure.
Figure 7:
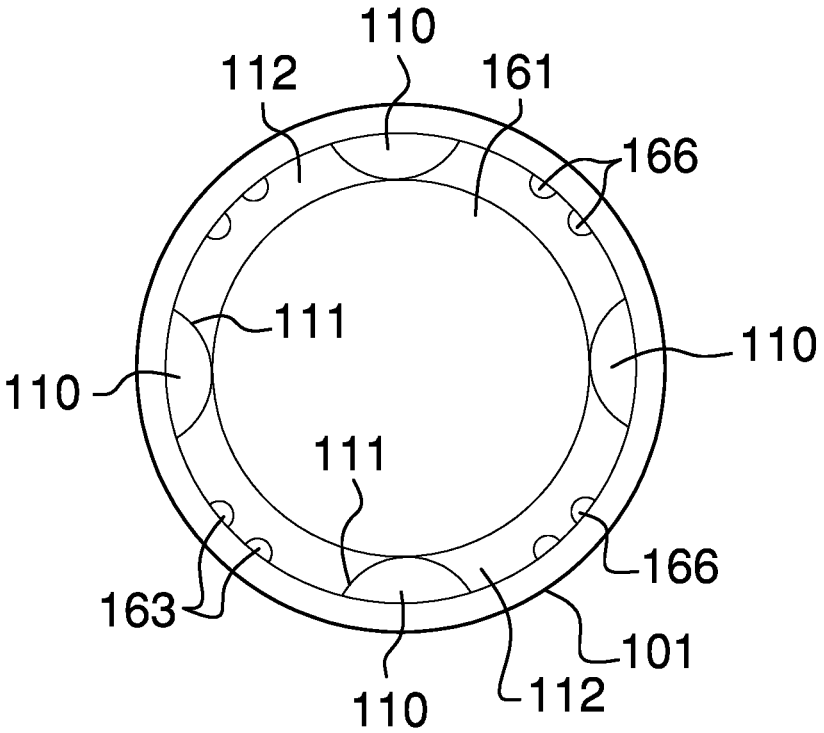
FIG. 7 is a detail view of an embodiment of the disclosure.

As shown in FIG. 5, to use the invention 100, the first base 131 of the pipe 101 is slipped over the oil filter 161 such that each individual ridge 110 selected from the plurality of ridges 102 is inserted into an indentation selected form the plurality of indentation 165. As shown most clearly in FIGS. 6 and 7, the invention 100 is secured to the oil filter 161, the plurality of ridges 102 forms a drainage space 112. Any oil that leaks 166 along the surface of the oil filter 161 will be captured within the pipe 101 such that the leaked oil 166 will be channeled to the second base 132 wherein the leaked oil 166 will further drip into the catch pan 163.

In a second potential embodiment of the disclosure, a first rim 141 and a second rim 142 are formed on the exterior surface. The first rim 141 follows the perimeter of the second base 132. The second rim 142 follows the circumference of the face 133.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Diameter: As used in this disclosure, a diameter of an object is a straight-line segment that passes through the center of an object. The line segment of the diameter is terminated at the perimeter or boundary of the object through which the line segment of the diameter runs.

Elastic: As used in this disclosure, an elastic is a material or object that deforms when a force is applied to it and that is able to return to its original shape after the force is removed. A material that exhibits these qualities is also referred to as an elastomeric material.

Ellipsoid: As used in this disclosure, an ellipsoid is a three dimensional geometric surface through which all planar surfaces are from either circles or ellipses. An ellipsoid is a type of quadric surface.

Engine: As used in this disclosure, an engine is a device with moving parts that is used to convert energy into rotational or linear motion.

Exterior: As used in this disclosure, the exterior is use as a relational term that implies that an object is not contained within the boundary of a structure or a space.

Inner Diameter: As used in this disclosure, the term inner diameter is used in the same way that a plumber would refer to the inner diameter of a pipe.

Interior: As used in this disclosure, the interior is use as a relational term that implies that an object is contained within the boundary of a structure or a space.

Outer Diameter: As used in this disclosure, the term outer diameter is used in the same way that a plumber would refer to the outer diameter of a pipe.

Pipe: As used in this disclosure, the term pipe is used to describe a rigid hollow cylinder. While pipes that are suitable for use in this disclosure are often used to transport or conveys fluids or gases, the purpose of the pipes in this disclosure are structural. In this disclosure, the terms inner diameter of a pipe and outer diameter are used as they would be used by those skilled in the plumbing arts.

Quadric Surface: As used in this disclosure, a quadric surface is a three dimensional surface that varies in the three Cartesian coordinates in an algebraically defined manner that is related to conic sections. Euclidian planes as well as the surfaces of ellipsoids, spheres, paraboloids, and cones are examples of quadric surfaces. The Euclidian plane is technically considered a degenerate form of a quadric surface and, unless specifically stated otherwise within this disclosure, is explicitly included in this definition. Quadric surfaces are described by the general algebraic form: $Ax^2+By^2+Cz^2+Dxy+Exz+Fyz+Gx+Hy+Iz+J=0$.

Relaxed Shape: As used in this disclosure, a structure is considered to be in its relaxed state when no shear, strain, or torsional forces are being applied to the structure.

Ridge: As used in this disclosure, a ridge is an elevated or raised portion of a structure.

Rigid Structure: As used in this disclosure, a rigid structure is a solid structure that is inflexible and will not deform before breaking under a force.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Vehicle: As used in this disclosure, a vehicle is a motorized device that is used in transporting or carrying passengers, goods, or equipment.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hand tool for installing and removing an oil filter from a vehicle engine, wherein the oil filter is defined with an outer diameter and a plurality of indentations, the hand tool comprising:

a pipe and a plurality of ridges;

wherein the pipe is a cylindrically shaped hollow structure defining a first base, a second base, a face, an interior surface and an exterior surface;

wherein the first base is open and the second base is open;

wherein the plurality of ridges are mounted on an the interior surface of the pipe;

wherein the plurality of ridges comprises a collection of individual ridges;

wherein any individual ridge selected from the plurality of ridges is identical to the individual ridges remaining within the plurality of ridges;

wherein each individual ridge is a semi-rigid structure that is formed from an elastomeric material;

wherein the hand tool contains oil leaks resulting from the removal of the oil filter from the vehicle engine;

wherein the pipe is a rigid structure;

wherein each individual ridge is shaped such that each individual ridge presents a convex surface towards a center axis of the pipe;

wherein the convex surface of each individual ridge is an ellipsoidal segment;

wherein each individual ridge forms a hollow space between the convex surface and the interior surface of the pipe;

wherein the pipe further comprises a first rim;

wherein the first rim is formed at the perimeter of the second base;

wherein the pipe further comprises a second rim;

wherein the second rim is formed on the face;

wherein when the hand tool is secured to the oil filter the plurality of ridges forms a drainage space.

2. The hand tool according to claim 1 wherein the pipe further comprises an inner diameter;

wherein the span of the inner diameter is greater than the span of an outer diameter of the oil filter.

3. The hand tool according to claim 1 wherein each individual ridge selected from the plurality of ridges are positioned such that each individual ridge is equidistant for each of the individual ridges to which the selected individual ridge is adjacent.

4. The hand tool according to claim 3 wherein each individual ridge is sized and shaped such that the individual ridge will fit into an indentation selected from the plurality of indentations of the oil filter.

5. The hand tool according to claim 4 wherein the semi-rigid structure that forms the individual ridge deforms under a force in an elastic manner.

6. The hand tool according to claim 5 wherein each individual ridge is a spring.

7. The hand tool according to claim 6 wherein when an oil filter is inserted into the pipe each of the plurality of ridges produces a clamping force that holds the hand tool securely in position against the oil filter.

8. The hand tool according to claim 7 wherein the first base of the pipe is slipped over the oil filter such that each individual ridge selected from the plurality of ridges is inserted into an indentation selected form the plurality of indentation.

* * * * *